US009153131B2

(12) United States Patent
Santucci et al.

(10) Patent No.: US 9,153,131 B2
(45) Date of Patent: Oct. 6, 2015

(54) REAL-TIME DRIVE ASSISTANCE SYSTEM AND METHOD

(75) Inventors: Mario Donato Santucci, Florence (IT); Onorino Di Tanna, Ponsacco (IT); Sergio Matteo Savaresi, Cremona (IT); Vincenzo Manzoni, S. Pellegrino Terme (IT); Andrea Corti, Drezzo (IT)

(73) Assignee: Piaggio & C. S.p.A., Pontedera (IT)

( * ) Notice: Subject to any disclaimer, the term of this patent is extended or adjusted under 35 U.S.C. 154(b) by 8 days.

(21) Appl. No.: 13/995,502

(22) PCT Filed: Dec. 23, 2011

(86) PCT No.: PCT/IB2011/055943

§ 371 (c)(1),
(2), (4) Date: Aug. 8, 2013

(87) PCT Pub. No.: WO2012/090144

PCT Pub. Date: Jul. 5, 2012

(65) Prior Publication Data

US 2013/0321179 A1 Dec. 5, 2013

(30) Foreign Application Priority Data

Dec. 27, 2010 (IT) ..... MI2010A2408

(51) Int. Cl.
*G08G 1/123* (2006.01)
*G08G 1/09* (2006.01)
(Continued)

(52) U.S. Cl.
CPC ..... *G08G 1/0969* (2013.01); *G08G 1/0104* (2013.01); *G08G 1/0112* (2013.01);
(Continued)

(58) Field of Classification Search
CPC ..... G08B 21/06; Y02T 10/84; A61B 5/0476; A61B 5/16; A61B 5/7203; A61B 5/7257; A61B 2503/22; A61B 5/048; H01M 10/052; H01M 4/366; H01M 4/525; H01M 4/62; B60K 28/06
USPC ..... 340/990, 988, 574, 573.1, 540, 995.25, 340/936, 933, 575, 438; 701/210, 200, 117, 701/24, 213; 342/357.01, 357.9, 357.08
See application file for complete search history.

(56) References Cited

U.S. PATENT DOCUMENTS 6,542,818 B1 * 4/2003 Oesterling ..... 701/454
(Continued)

FOREIGN PATENT DOCUMENTS

DE 102009018741 A1 10/2010
EP 1868175 A2 12/2007
EP 2196971 A1 6/2010

OTHER PUBLICATIONS

International Search Report and Written Opinion issued in corresponding International Patent Application No. PCT/IB2011/055943 dated Sep. 12, 2012 (15 pages).
Oulasvirta et al., "ContextPhone: A Prototyping Platform for Context-Aware Mobile Applications," Pervasive Computing, vol. 4, No. 2, Apr. 1, 2005, pp. 51-59.

*Primary Examiner* — Mirza Alam
(74) *Attorney, Agent, or Firm* — Kilyk & Bowersox, P.L.L.C.

(57) ABSTRACT

A real-time drive assistance system and method are provided. The system includes a centralized architecture capable of determining and preventing, in real time, potentially dangerous road situations, increasing road safety. The system is based on a communication network obtained through specific portable mobile communication devices exchanging information related to the state of a plurality of vehicles in motion along a road network. The method includes periodical acquisition and sending of the information to a centralized processing unit using the wireless communication system of each portable mobile communication device; processing of the information in order to verify the occurrence of potential dangerous situations for the drivers of each vehicle; and sending of warning or danger signals to one or more of the portable mobile communication devices that can alert the drivers of the vehicles.

15 Claims, 3 Drawing Sheets

(51) Int. Cl.

| | |
|---|---|
| ***G05D 1/00*** | (2006.01) |
| ***G06F 19/00*** | (2011.01) |
| ***G08G 1/0969*** | (2006.01) |
| ***G08G 1/01*** | (2006.01) |
| ***G08G 1/0967*** | (2006.01) |
| ***G08G 1/16*** | (2006.01) |

(52) U.S. Cl.
CPC .... *G08G1/096716* (2013.01); *G08G 1/096741* (2013.01); *G08G 1/096775* (2013.01); *G08G 1/164* (2013.01)

(56) References Cited

U.S. PATENT DOCUMENTS

| | | | | |
|---|---|---|---|---|
| 7,203,598 | B1 * | 4/2007 | Whitsell | 701/521 |
| 2003/0137426 | A1 * | 7/2003 | Anthony et al. | 340/574 |
| 2005/0273255 | A1 * | 12/2005 | Watkins et al. | 701/210 |
| 2008/0114430 | A1 * | 5/2008 | Collins | 607/106 |
| 2008/0114530 | A1 | 5/2008 | Petrisor et al. | |
| 2009/0184828 | A1 * | 7/2009 | Speller | 340/575 |
| 2009/0309757 | A1 * | 12/2009 | Mudalige et al. | 340/905 |

* cited by examiner

REAL-TIME DRIVE ASSISTANCE SYSTEM AND METHOD

This application is a National Stage Application of PCT/IB2011/055943, filed Dec. 23, 2011, which claims priority to Italian Patent Application No. MI2010A002408, filed Dec. 27, 2010.

The present invention relates to a real-time drive assistance system and method, in particular to a drive assistance system and method based on mobile devices and on a centralized architecture.

The growth of the mobility of people and goods has implied a social and economic cost that increases every year. The main reason for such increase is found in road accidents. 218,963 road accidents occurred in 2008 in Italy, of which 2.16% were mortal. The main causes are to be ascribed to the failure to observe right of way rules, careless driving and too high speed, which by themselves represent 44% of the causes for collisions. In particular, motorcyclists are particularly sensitive subjects in this topic: while on the overall, motorcycles only represent 8% of the registered vehicles, motorcyclists are victims of 26% of mortal accidents (source: ISTAT, 2008).

The relevant national and international institutions have long been involving the major vehicle manufacturers to devise and adopt solutions for increasing road safety. The solutions introduced in modern means of road transportation consist in independent drive assistance systems which, in particular conditions, provide an aid to the driver or fully replace him/her.

Drive assistance systems installed onboard of the vehicles help the driver to prevent, or at least lessen, the consequences of an accident through sensors that can determine the nature and the extent of an imminent danger. According to the dangerousness and to the time factor associated to the risk, these drive assistance systems can both quickly warn the driver of the imminent danger, and optionally actively assist him/her, intervening to avoid the accident or at least lessen the consequences thereof.

However, in many traffic situations, especially if characterized by an interaction between multiple road users (drivers, motorcyclists, pedestrians, etc.), it is almost impossible to identify and prevent possible dangers using only the sensors present onboard of the vehicle. For example, such sensors are not usually capable of identifying a still vehicle behind a blind curve. The need of finding alternative systems and methods for solving the problems related to road safety arises from these considerations.

One of the alternative solutions that are used the most is the one that provides for a dedicated communication system between vehicles, based on wireless connections, which allows extending the possibilities of identifying dangerous situations with sufficient advance. According to such system, each vehicle is provided with a computing intelligence (computer) onboard which, receiving a plurality of signals related to the behaviour of the vehicles around it in input from proper sensors, is capable of reconstructing a dynamic map of the road and of the means of transport present thereon. Analyzing this structured information it is possible to foreseen, in an autonomous and decentralized manner, risk situations for the driver.

The drawbacks of this system reside in the need of equipping each vehicle with adequate electronic devices capable of setting up a dedicated communication. Such electronic devices, which must be provided with a considerable computing capacity, also require a specific design in relation to the type of vehicle whereon they must be installed. In short, such electronic devices involve a considerable cost both for vehicle manufacturers and for the service users.

Document US2008/114530A1 describes a drive assistance system comprising a plurality of mobile communication devices, present onboard of the vehicles, and a plurality of local processing units (RSE), installed at respective fixed positions (nodes). Local maps are installed on the local processing units and the algorithms for estimating the danger scenarios are executed. The drawbacks of this system reside in the need of making significant economic investments for installing several local processing units, as well as in the need of making multiple updates, that is, on every single local processing unit, of the digital maps and of the algorithms for calculating the danger scenarios.

Document EP 2 196 971 A1 describes a system for gathering information related to the traffic conditions and distributing such information to a plurality of mobile communication devices (mobile clients). The system is based on a web server. The main drawback of such system resides in the fact that the information related to the traffic conditions is managed with slow dynamics. On the other hand, a centralized system for road safety applications must be capable of managing very quick dynamics. For this reason, such system requires an "ad hoc" development, using advanced and efficient signal processing, road snapping and information technology techniques. Only in this way it is possible to ensure that the centralized system operates in real time.

Document EP 1 868 175 A2 describes a communication system for moving vehicles wherein the mobile communication devices consist of common radio equipment. A centralized server is provided, which is not provided with digital maps, therefore it can only manage some subcategories of safety applications (for example, bumping), but is not capable of determining complex situations (for example approach/right of way at crossroads). The system described in document EP 1 868 175 A2 is in fact dedicated to railway and sea transport and is not conveniently adaptable to road transport.

Document DE 10 2009 018741 A1, finally, describes a system for signalling danger situations to vehicle drivers. The system uses no digital maps, which instead are indispensable for determining complex danger situations and for correcting localization errors.

The object of the present invention therefore is to provide a real-time drive assistance system and method, in particular a drive assistance system and method based on mobile devices and on a centralized architecture, capable of solving the drawbacks of the prior art mentioned above in a very simple, inexpensive and particularly functional manner.

In detail, one object of the present invention is to provide a real-time drive assistance system and method capable of providing the same performance of the current dedicated communication systems between vehicles, without the need of providing for the presence of specific electronic devices installed onboard of the same vehicles.

Another object of the invention is to provide a real-time drive assistance system and method which are easily applicable to a wide range of vehicles, among which in particular motorcycles.

Another object of the invention is to provide a real-time drive assistance system and method which are particularly simple and intuitive to be used from the point of view of the end user.

These objects according to the present invention are achieved by providing a real-time drive assistance system and method, in particular a drive assistance system and method based on mobile devices and on a centralized architecture, as described in the independent claims.

Further features of the invention are described in the dependent claims, which are an integral part of the present description.

The features and the advantages of a real-time drive assistance system and method according to the present invention will appear more clearly from the following description, made by way of an indicative non-limiting example with reference to the annexed schematic drawings, wherein.

Figure 1:
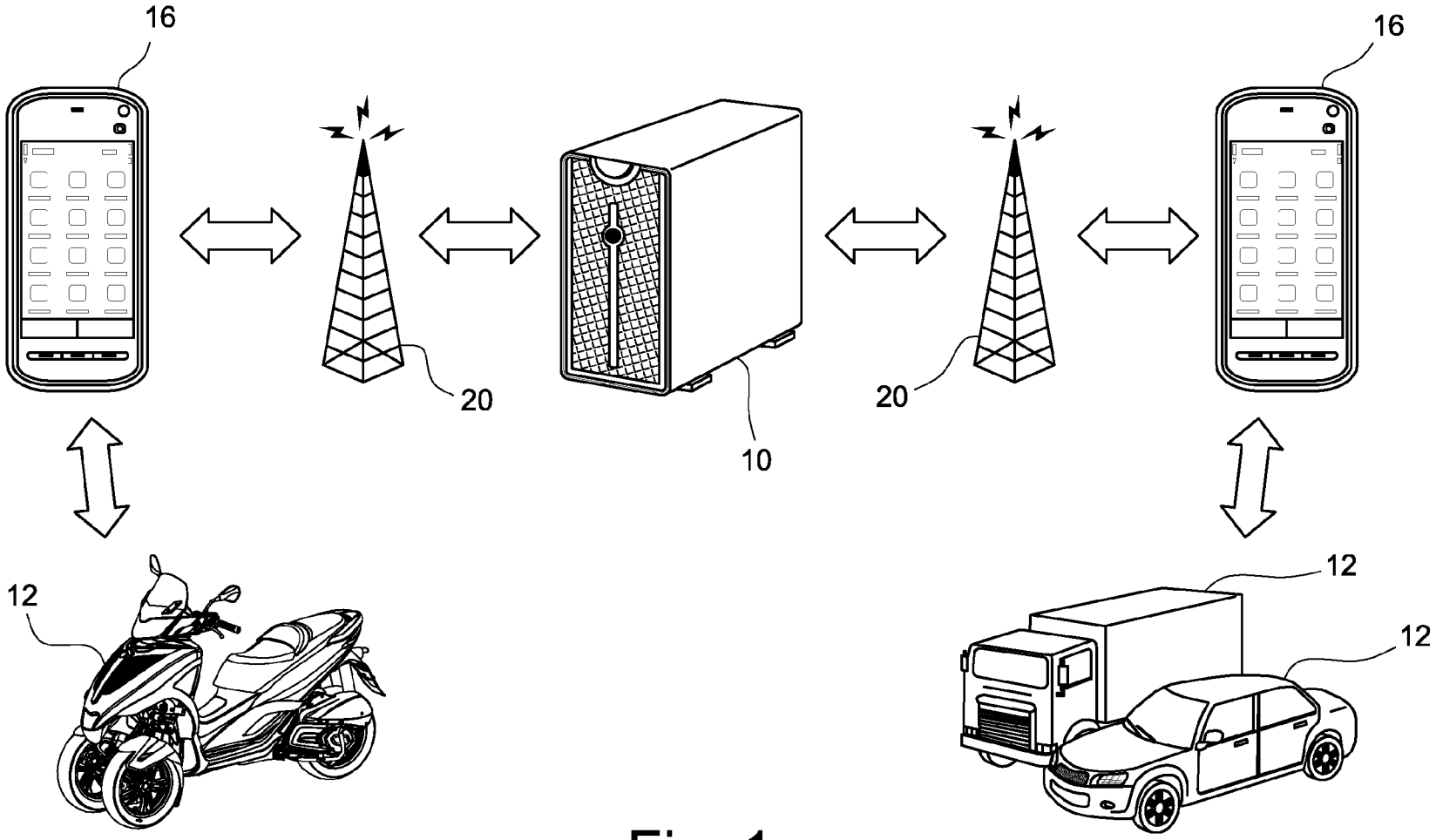
FIG. 1 shows an exemplary schematic view of the base components of the real-time drive assistance system according to the present invention.
Figure 2:
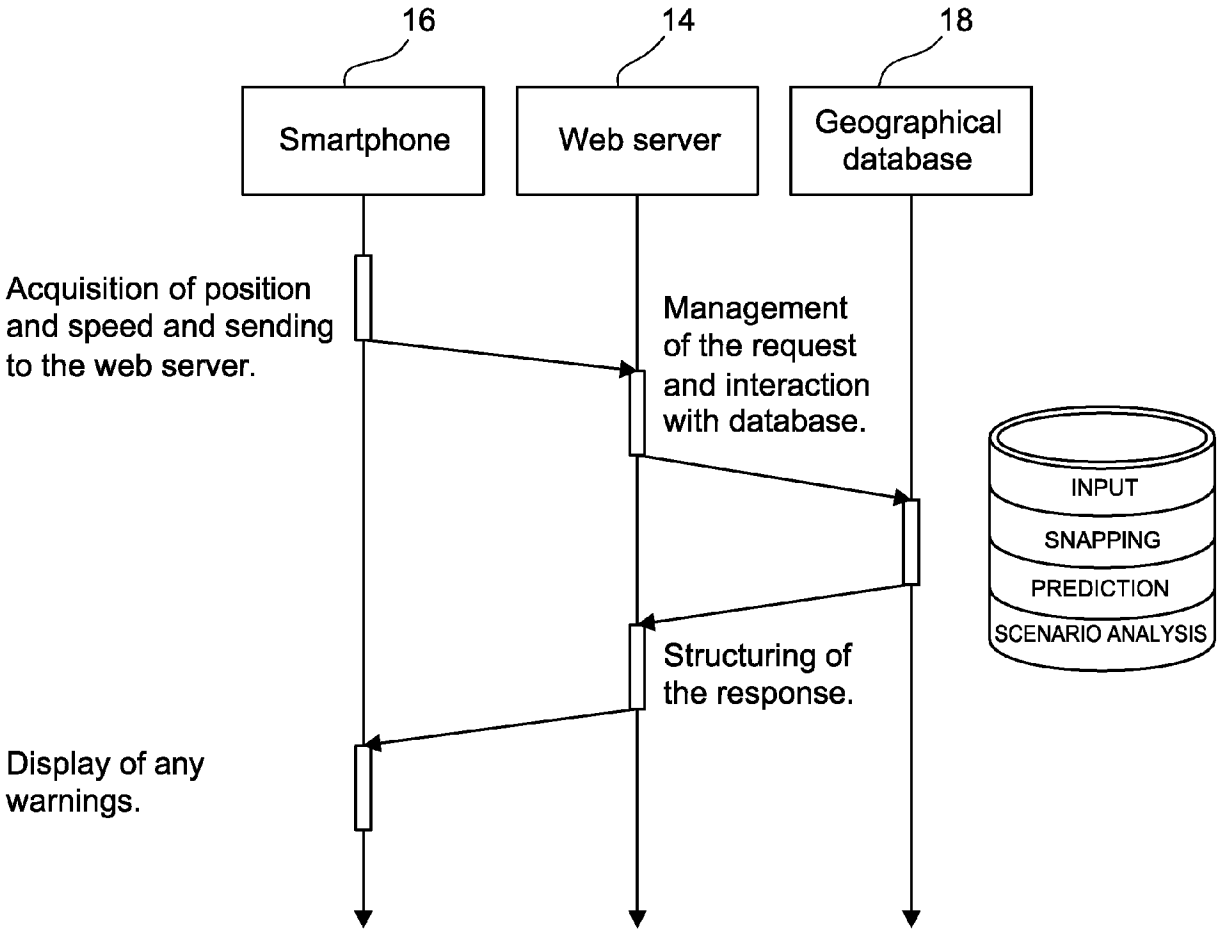
FIG. 2 shows a block diagram showing, at a high level, the temporal sequence of the operations performed by the real-time drive assistance system and method according to the present invention.
Figure 4:
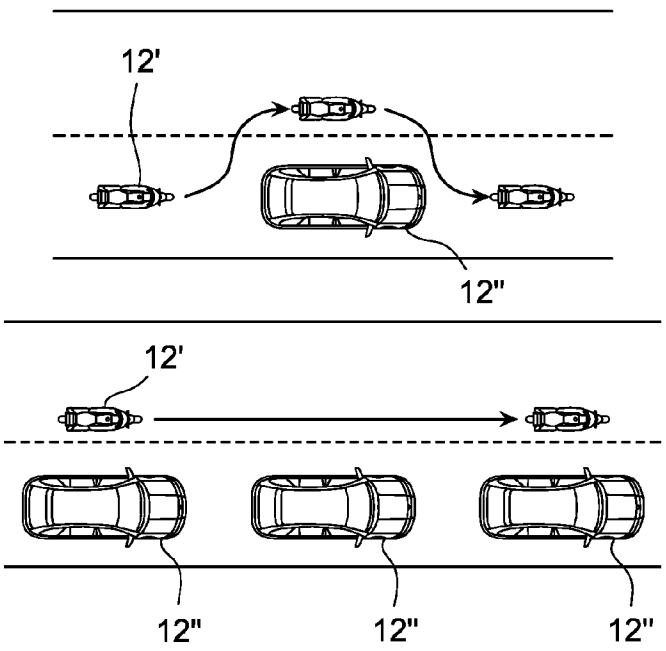
FIG. 4 shows a schematic top view illustrating the exemplary embodiment of the real-time drive assistance system and method of FIG. 3.

With reference to the figures, there are shown a real-time drive assistance system and a method according to the present invention. The drive assistance system according to the present invention proposes a centralized architecture capable of determining and preventing, in real time, potentially dangerous road situations, increasing road safety.

The system is based on a communication network obtained through specific mobile communication devices, such as for example the so-called "smartphones" or "intelligent mobile phones". Such mobile communication devices are portable devices that combine additional features, among which the possibility of installing application programs, besides the typical ones of the most common mobile phones. In detail, smartphones are electronic devices that integrate one or more processing units, one or more wireless communication systems (Bluetooth®, Wi-Fi, UMTS/GPRS, etc.), one or more user communication interfaces (display, audio, vibration) and use an operating system (Android, iOS, Symbian or others) that allows a high level programming.

The system according to the invention comprises, in the first place, a single centralized processing unit 10 operatively connected, through a suitable wireless communication network, to a plurality of mobile communication devices 16 present onboard of respective vehicles 12. The centralized processing unit 10 is capable of receiving a series of information related to the state of vehicles 12 in motion along a road network, as well as detecting road situations that are potentially dangerous for such vehicles 12. Among the information acquired by the centralized processing unit 10 there are at least the data related to the speed and to the geographical coordinates of each vehicle.

The minimum set of information related to the state of each vehicle 12 is directly detected by the GPS unit embedded in the mobile communication device (smartphone) 16. As an alternative, such minimum set of information may be provided by a GPS antenna external to the mobile communication device 16 and connected thereto through standard wireless communication systems (Bluetooth®, WiFi).

The centralized processing unit 10 in turn comprises:

- a web server 14 connected to the Internet, which acts as interface between each vehicle 12 and the relative mobile communication device (smartphone) 16 and which receives and processes the information received from each vehicle 12. Such web server may optionally be redundant for computing capacity requirements;
- a geographical database 18, provided with corresponding digital maps whereon vehicles 12 are positioned based on the information communicated thereby. The drive assistance algorithms are executed according to the position of such vehicles 12 on the map. The geographical database 18 may optionally be redundant or geographically partitioned for computing capacity requirements.

In order to be compatible with the real-time drive assistance system and method according to the present invention, each vehicle 12 needs to be equipped with:

- a mobile communication device (smartphone) 16, provided with a user identification card (Subscriber Identity Module or "SIM" card) and configured for being capable of accessing the Internet and communicating through a proper wireless communication system, preferably UMTS/GPRS. A specific application program must be installed and active on smartphone 16 capable of acquiring the information related to the state of vehicles 12 and exchanging such information with the web server 14;
- a GPS antenna 20, or a similar localization device based on a generic global navigation satellite system (or GNSS), capable of periodically providing, with a frequency of at least 1 Hz, the absolute geographical position of each vehicle 12 on the globe.

The satellite-based localization device 20 may be embedded in smartphone 16 (note that most modern smartphones embed a satellite-based localization device). As an alternative, the localization device 20 may consist of an external antenna, connected to smartphone 16 through a proper communication protocol of the Bluetooth® or Wi-Fi type.

The real-time drive assistance method according to the present invention therefore provides for a first step of periodical acquisition, through smartphone 16 and preferably at least once a second, information related to the state of each vehicle 12 in motion along the road network, among which at least the data related to speed and geographical position. The information thus obtained is sent to the centralized processing unit 10 through the wireless communication system (UMTS/GPRS) of smartphone 16.

The web server 14 of the centralized processing unit 10 receives the information coming from each smartphone 16 and performs both the memorization of such information into the geographical database 18, and processing of the same information. The geographical coordinates sent to the web server 14 are associated to a vector on the digital map, projecting it on the road where the vehicle 12 is driving on.

The future position of each vehicle 12 after a predefined time interval, in the order of some seconds, is estimated based on the current information acquired (among which, for example, previous positions, speed, acceleration, etc.). The web server 14 then performs a "scenario analysis", that is, analyzes the information related to each single vehicle 12 and to the vehicles present within a predefined distance or radius from such single vehicle 12 in order to verify the occurrence of potential dangerous situations for the respective drivers. Finally, the web server 14 sends any warning or danger signals, via UMTS/GPRS network, to the concerned smartphones 16, which can alert the drivers of vehicles 12 through acoustic, visual warnings or obtained through vibration. Such warnings may have variable intensity, tone and/or duration according to the seriousness of the danger and/or the approaching of the same danger.

It should be noted that having delegated the processing operations to a centralized server 10 makes the procedure for updating the relevant analysis software, as well as the maps, which need not be uploaded by all the users to their mobile communication devices 16, very streamlined. In this way, the users of the system according to the invention can use increasingly advanced features without any additional operations being required from them after the first installation of the application on their smartphone 16.

Moreover, the centralized architecture makes it very easy for the centralized processing unit 10 to connect to external services, such as for example real-time traffic or weather services, for correlating the scenario analyses to the information provided by these last-mentioned.

Figure 3:
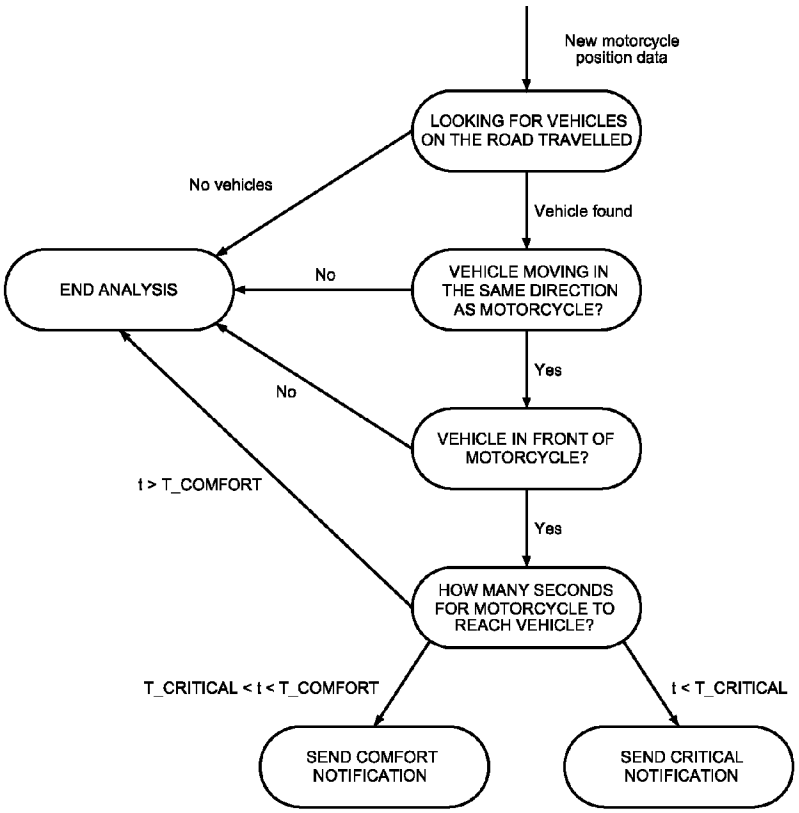
FIG. 3 shows a block diagram showing the steps of an exemplary embodiment of the real-time drive assistance system and method according to the present invention.

FIG. 3 shows an example of scenario analysis, wherein the conditions to be evaluated for identifying a specific usage case are described: the overtake by a vehicle, represented for example by a motorcycle 12', relative to another vehicle, represented by a motor car 12".

In the example shown, starting from the information related to the geographical position of motorcycle 12', the web server 14 search for further vehicles on the road travelled over by the same motorcycle 12' and within a predefined distance. If the presence of motor car 12" is detected within such predefined distance, the web server web 14 makes an analysis of the position and of the advance direction of motor car 12" to determine whether:

motor car 12" is moving in the same direction as motorcycle 12', and motor car 12" is in front of motorcycle 12'.

If both the above conditions are met, the web server 14 acquires the data related to the advance speed of both motorcycle 12' and of motor car 12", for calculating the time t, measured in seconds, motorcycle 12' will take to reach motor car 12". If the calculated time t is longer than a predefined time T_COMFORT, considered as acceptable for the driver of motor car 12" to have the possibility of becoming aware of the presence of motorcycle 12' and of autonomously evaluating the conditions for making any manoeuvres (lane change, overtaking, etc.), the web server 14 sends no signal to smartphones 16 provided on motorcycle 12' and on motor car 12".

If the calculated time t is comprised between a time value T_CRITICAL, considered as the minimum time threshold below which the occurrence of danger situations for the driver of motorcycle 12' is probable, and said time value T_COMFORT, the web server sends a signal to smartphone 16 provided on motor car 12", and optionally also to smartphone 16 provided on motorcycle 12', to indicate a non high risk situation. Finally, if the calculated time t is shorter than the time value T_CRITICAL, the web server 14 sends a signal to smartphone 16 provided on motor car 12", and optionally also to smartphone 16 provided on motorcycle 12', for immediately alerting the driver of motor car 12", and optionally also the driver of motorcycle 12', of the potential risk of a possible collision.

The real-time drive assistance system according to the present invention may provide for the use of fixed communication devices (not shown) installed on fixed places along the road network, for example on road signs or at critical points (accidents, building yards, dangerous crossroads, etc.), and operatively connected to the web server 14. In this way, the web server 14 is capable of automatically positioning such potentially dangerous fixed places on the map of the geographical database 18 and of communicating the presence thereof to the drivers of the approaching vehicles 12 through the respective smartphones 16.

It has thus been seen that the real-time drive assistance system and method according to the present invention achieve the objects mentioned above.

The real-time drive assistance system and method according to the present invention use the potential and the diffusion of smartphone devices for providing a communication system between vehicles characterized by a virtually null marginal cost. The centralized processing unit is responsible for the execution of the scenario analyses, which represent the most burdensome computational part. It is therefore possible to:

ensure high scalability, meant as the possibility of increasing the number of centralized processing units and of geographical databases as the number of vehicles using the service increases, separating different zones of the territory on a geographical basis;

reduce the complexity of the application program installed on the smartphones, making it easily portable and maintainable on the different operating systems currently provided for smartphone devices (Android, iOS, Symbian or others).

The advantages of the real-time drive assistance system and method of the present invention, compared to the implementation of a communication between vehicles with dedicated hardware and decentralized architecture, are clear from both the economic point of view, since the cost of new electronic devices to be installed onboard of the vehicle is totally eliminated, and from the point of view of the potential penetration of the same system into the market, favoured by the diffusion of smartphones and of the mobile data connectivity.

In any case, several changes and variations may be made to the real-time drive assistance system and method of the present invention thus conceived, all falling within the same inventive concept. The scope of protection of the invention therefore is defined by the annexed claims.

The invention claimed is:

1. Real-time drive assistance system comprising:

a single centralized processing unit able to receive a plurality of information related to a state of a plurality of vehicles in motion along a road network, and to detect road situations that are potentially dangerous for said vehicles, the centralized processing unit comprising in turn a web server connected to Internet, that receives and processes the information received by each vehicle, and a geographical database, provided with corresponding digital maps on which the vehicles are positioned according to the information communicated thereby;

a plurality of portable mobile communication devices present onboard the respective vehicles, each portable mobile communication device consisting of a smartphone configured for being able to access the Internet and provided with:

one or more processing unit, one or more wireless communication systems, a user identification card ("SIM" card), an operating system that allows a high level programming, one or more application programs capable of acquiring the information related to the state of the vehicles and exchanging said information with the web server, one or more user communication interfaces for generating warnings that alert drivers of the vehicles based on the processing performed by the web server, a localization device based upon a global satellite navigation system, able to detect the information related to a state of each vehicle and to periodically provide an absolute global geographic position of each vehicle, wherein said web server is configured to search further vehicles on the road travelled by a first vehicle and if at least a further vehicle is found within a predefined distance from the first vehicle, said web server is configured to analyze a position and an advance direction of said further vehicle in order to provide to the first vehicle or both vehicles a notification concerning a risk of possible collision.

2. The real-time drive assistance system according to claim 1, characterized in that the localization device is a GPS antenna.

3. The real-time drive assistance system according to claim 1, characterized in that the localization device is embedded in the portable mobile communication device.

4. The real-time drive assistance system according to claim 1, characterized in that the localization device is made by an external antenna, connected with the portable mobile communication device by means of a proper communication protocol of the Bluetooth'9 or Wi-Fi type.

5. The real-time drive assistance system according to claim 1, comprising one or more fixed communication devices installed on fixed places along the road network, and operatively connected to the web server, said fixed communication devices signaling to the portable mobile communication devices of drivers of approaching vehicles a presence of said fixed places when they are potentially dangerous.

6. The real-time drive assistance method comprising the following steps:

periodical acquisition, by means of a plurality of portable mobile communication devices, of the information related to the state of a plurality of vehicles in motion along a road network;

sending of the information so obtained to a single centralized processing unit through a wireless communication system of each portable mobile communication device;

processing of the information by means of the centralized processing unit in order to verify an occurrence of potential dangerous situations for drivers of each vehicle;

sending, by the centralized processing unit and through the wireless communication system, of warning or danger signals to one or more of said portable mobile communication devices for generating warnings that alert the drivers of the vehicles; and searching with said web server further vehicles on a road travelled by a first vehicle and if at least a further vehicle is found within a predefined distance from the first vehicle, analyzing a position and an advance direction of said further vehicle in order to provide to the first vehicle a notification concerning a possible risk in case of overtaking of the further vehicle by the first vehicle, wherein the step of processing the information of the centralized processing unit comprises the following steps:

memorization of said information on a geographic database;

generation of a vector on a digital map, corresponding to a route travelled by each vehicle;

estimation, according to the information, of a future position of each vehicle after a predefined period of time;

analysis of the information related to each single vehicle and to the vehicles present within a predefined distance or radius from said single vehicle in order to verify the occurrence of potential dangerous situations for the drivers.

7. The method according to claim 6, wherein the step of periodical acquisition of the information related to a state of each vehicle is performed by the localization device based on the global satellite navigation system.

8. The method according to claim 6, wherein the warnings generated by the portable mobile communication devices have an a) intensity, b) tone, or c) duration variable according to seriousness of the danger or an approaching of said danger or both, or, d) any combination of a), b), and c).

9. The method according to claim 6, wherein information related to a state of each vehicle comprises at least data related to a speed and a geographic position of said vehicle.

10. The method according to claim 9, wherein the information related to the state of each vehicle further comprises data related to an acceleration of said vehicle.

11. The method according to claim 6, wherein the warnings generated by each portable mobile communication device are of an acoustic type.

12. The method according to claim 6, wherein the warnings generated by each portable mobile communication device are of a visual type.

13. The method according to claim 6, wherein the warnings generated by each portable mobile communication device are obtained by means of vibrations.

14. The real-time drive assistance system according to claim 1, wherein said one or more application programs are configured for acquiring the information related to the state of the vehicles at least once a second.

15. The method according to claim 6, wherein said periodical acquisition step is performed at least once a second.

* * * * *